United States Patent [19]

Duggan

[11] Patent Number: 4,478,886

[45] Date of Patent: Oct. 23, 1984

[54] METHOD OF TREATING AND COATING A FABRIC WEB

[76] Inventor: Eric Duggan, 8 Oakdale Grove, Laverton, Victoria, Australia, 3028

[21] Appl. No.: 372,527

[22] Filed: Apr. 28, 1982

[30] Foreign Application Priority Data

Apr. 29, 1981 [AU] Australia ..... PE8646

[51] Int. Cl.[3] ..... B05D 3/02; B05D 5/06

[52] U.S. Cl. ..... 427/210; 8/151; 68/9; 118/67; 427/288; 427/381

[58] Field of Search ..... 68/205 R, 9, 62, 200; 427/209, 210, 288, 381; 118/67, 412; 8/151

[56] References Cited

U.S. PATENT DOCUMENTS

| | | | |
|---|---|---|---|
| 4,027,062 | 5/1977 | Engelbrecht et al. | 427/209 X |
| 4,068,501 | 1/1978 | Aronoff et al. | 68/205 R X |
| 4,206,618 | 6/1980 | Schiffer | 68/205 R X |
| 4,338,876 | 7/1982 | Norton | 68/205 R X |

FOREIGN PATENT DOCUMENTS

| | | |
|---|---|---|
| 623183 | 5/1949 | United Kingdom . |
| 814100 | 5/1959 | United Kingdom . |
| 925168 | 5/1963 | United Kingdom . |
| 1047955 | 11/1966 | United Kingdom . |
| 1362174 | 7/1974 | United Kingdom . |
| 1403983 | 8/1975 | United Kingdom . |

*Primary Examiner*—Philip R. Coe

*Attorney, Agent, or Firm*—Larson & Taylor

[57] ABSTRACT

A web treating method for treating both surfaces of a web of material, such as canvas, including treatment stations so arranged to place a coating on each side of the web; the web passing through at least one treatment station while running in one direction and through at least one other station after the direction of movement of the web has been reversed.

8 Claims, 6 Drawing Figures

METHOD OF TREATING AND COATING A FABRIC WEB

Figure 1:
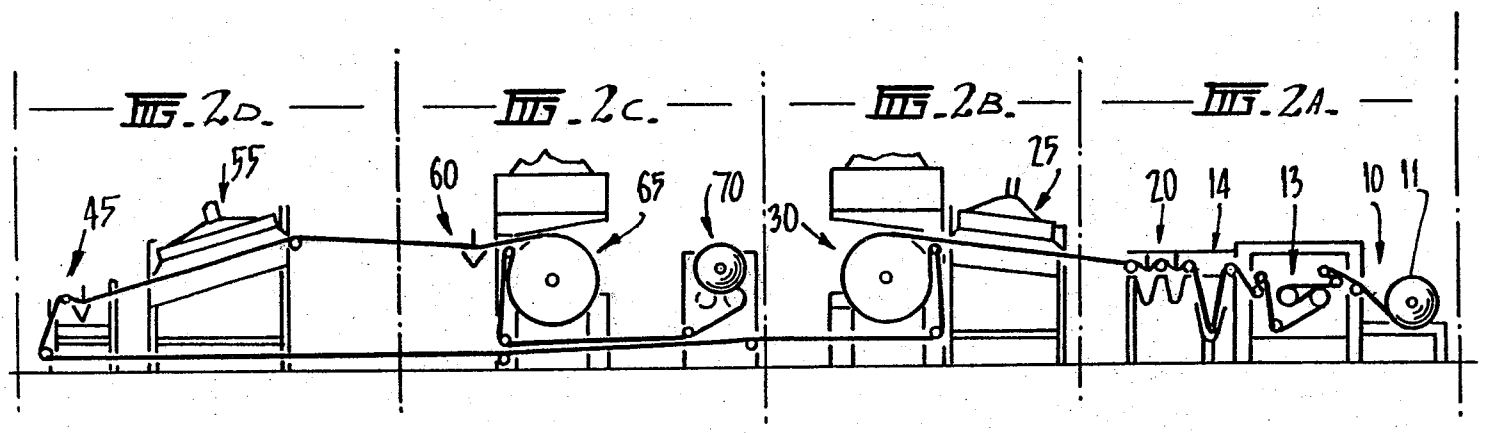

This invention relates to an improved web treating method. It is particularly adapted for treating webs of fabric material.

Specifically the invention is adapted for treating webs of canvas material.

Conventionally, canvas material, if it is to be used for awnings, tents or the like, goes through a number of treatment steps. There may be four such steps.

The first of these is to treat the fabric with a fungicide or the like so that it becomes resistant to mould growth. Secondly, it is given a backing coat of a filler material for opacity. Thirdly, it is provided with a decorative coating, and fourthly it is provided with a coat to provide good anti-soil and water repellent properties so that dust and dirt do not get into the body of the material and is relatively easily removed therefrom.

It will be seen that in order to provide the various coatings it is desirable to pass the web through coating stations with different surfaces of the web being uppermost, as various coatings are provided to opposite faces of the web.

Conventionally, this has been done by passing the web from a feed reel to a take-up reel on four different occasions with the side of the web being fed uppermost from the feed reel being varied depending upon which side of the web is being treated, and the manner in which the treatment is effected.

It will be seen that such processes have two major disadvantages.

Firstly, they are slow, in that the operations on the web are repetitive, and they are expensive of labour as the web has to be fed through four different machines and transported from one machine to another.

It is an object of the present invention to provide a web treating method which minimises these difficulties.

In the broadest sense my method comprises receiving a reel of web material, a first treatment station whereby at least one surface of the web is treated with a liquid, a second treatment station in which one side of the fabric is treated with a liquid coating; a third treatment station whereby the other side of the fabric is treated selectively with a further coating.

The method may provide drying after each or some of the treatment stations whereby the treated web can be dried.

The method may be such that the first and second treatment stations apply the treatment to the fabric when it is running in one direction and the third and fourth treatment stations feed the fabric when it is running in the opposite direction whereby each side of the fabric can be treated with the previously treated side being downwardly directed.

The invention also includes the method of treating a fabric web comprising treating one surface of the fabric with a liquid at a treatment station while it is running in one direction, reversing the direction of movement of the web and treating the opposite surface with at least one further liquid and taking up the fabric.

Figure 2A:
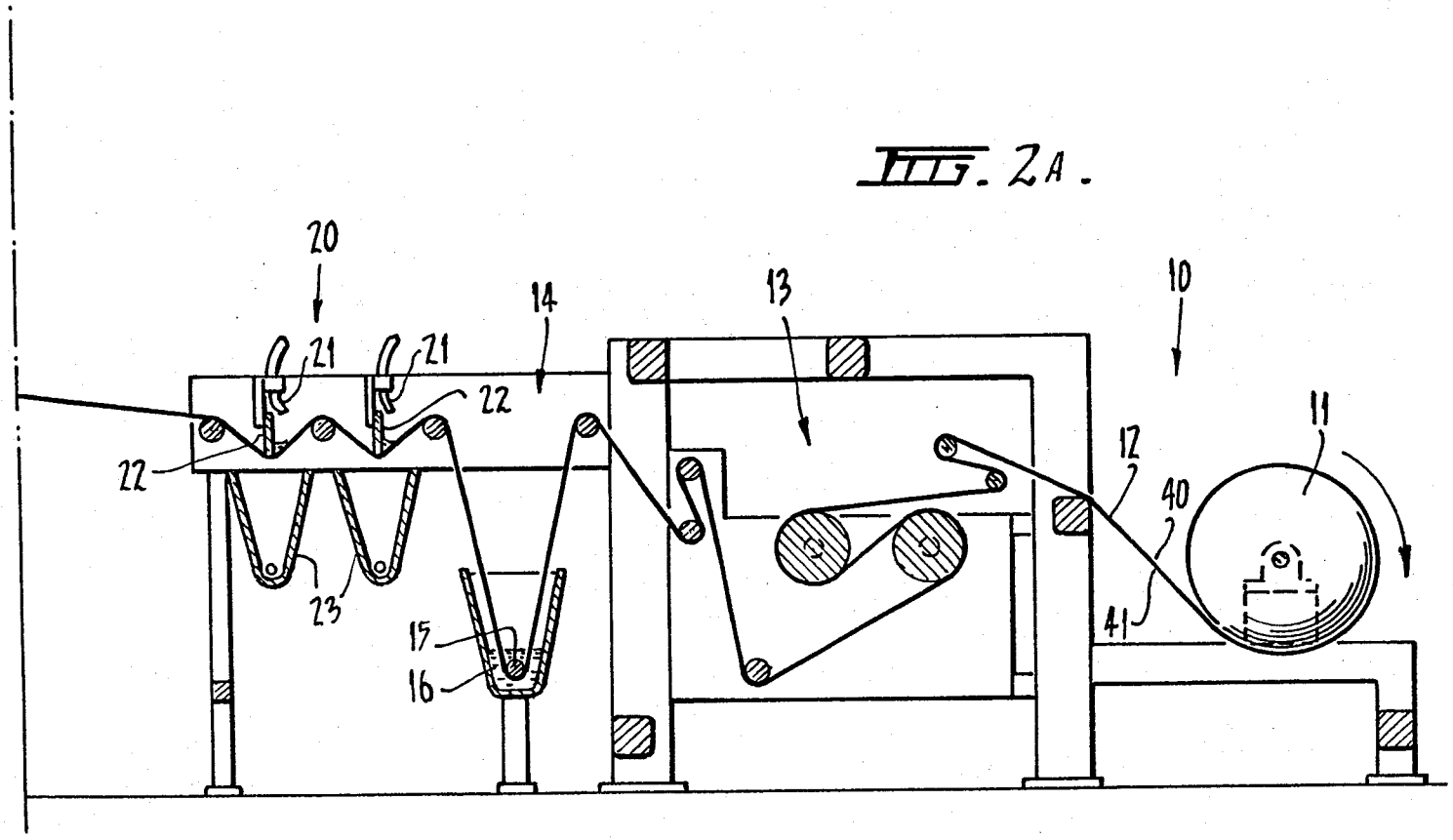
Figure 2B:
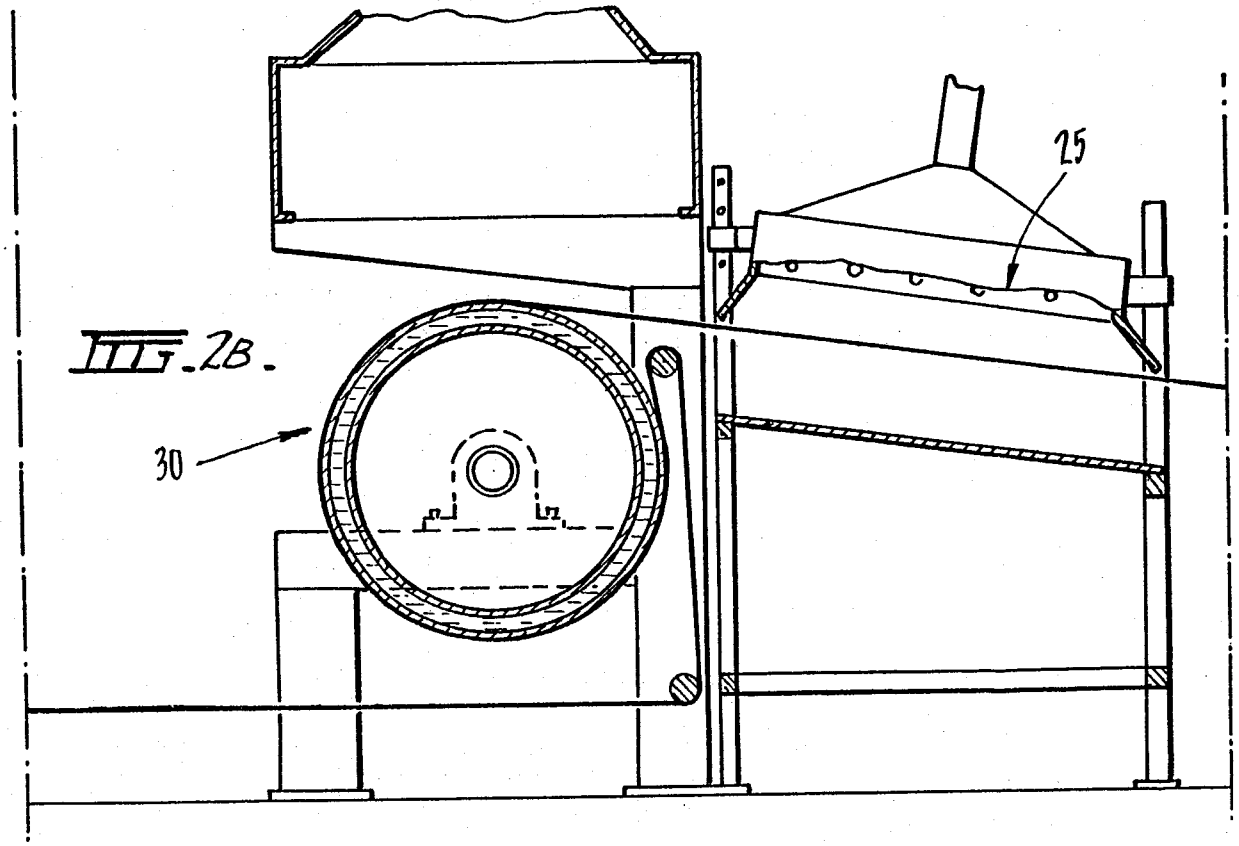
Figure 2C:
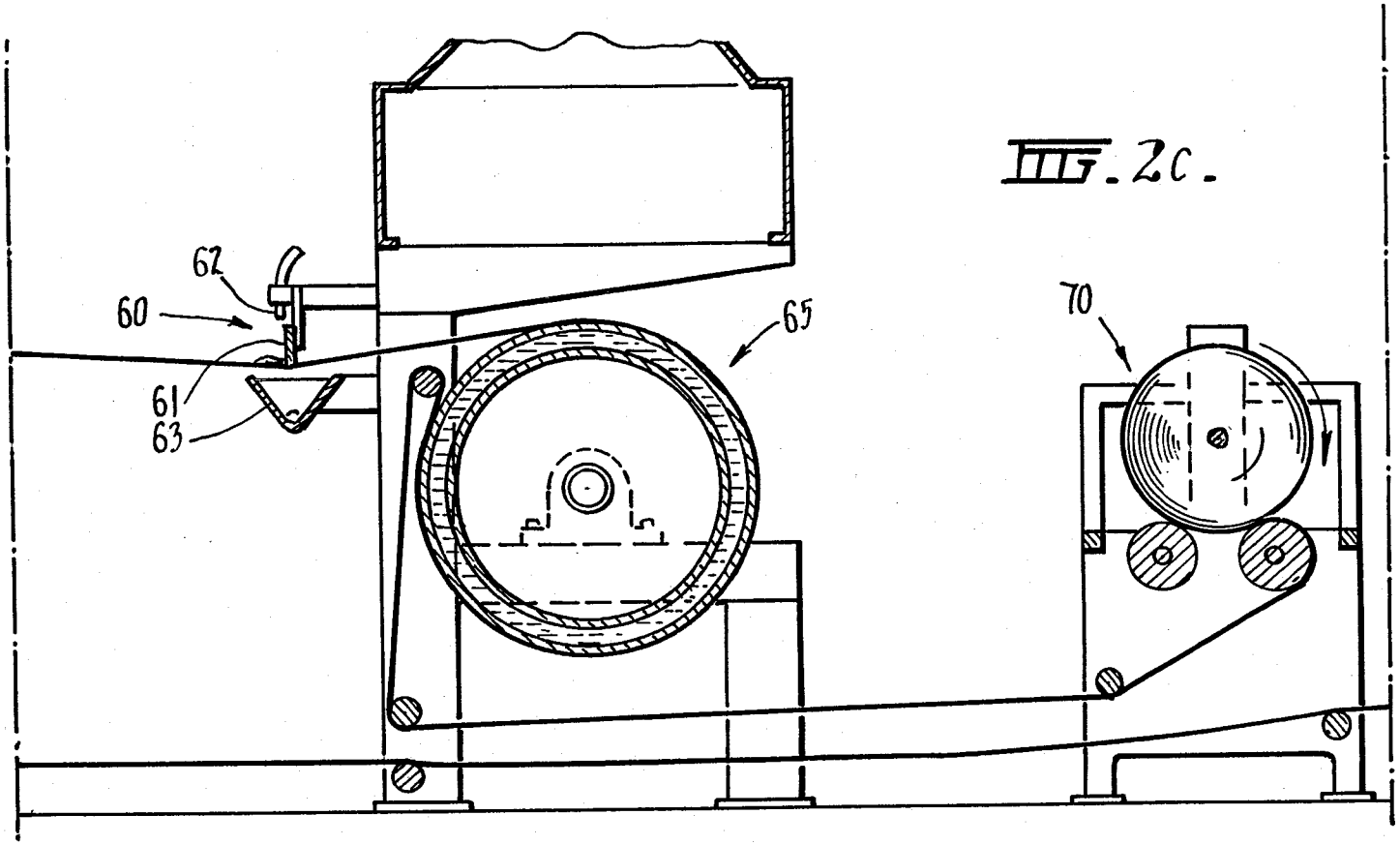

In order that the invention may be more readily understood, I will describe one particular form of apparatus for carrying out the method of the invention in relation to the accompanying drawings, in which:

FIG. 1 is a schematic view of the machine as a whole;

FIGS. 2A,B,C and D are enlarged views of the components of FIG. 1; and

Figures 2D, 3:
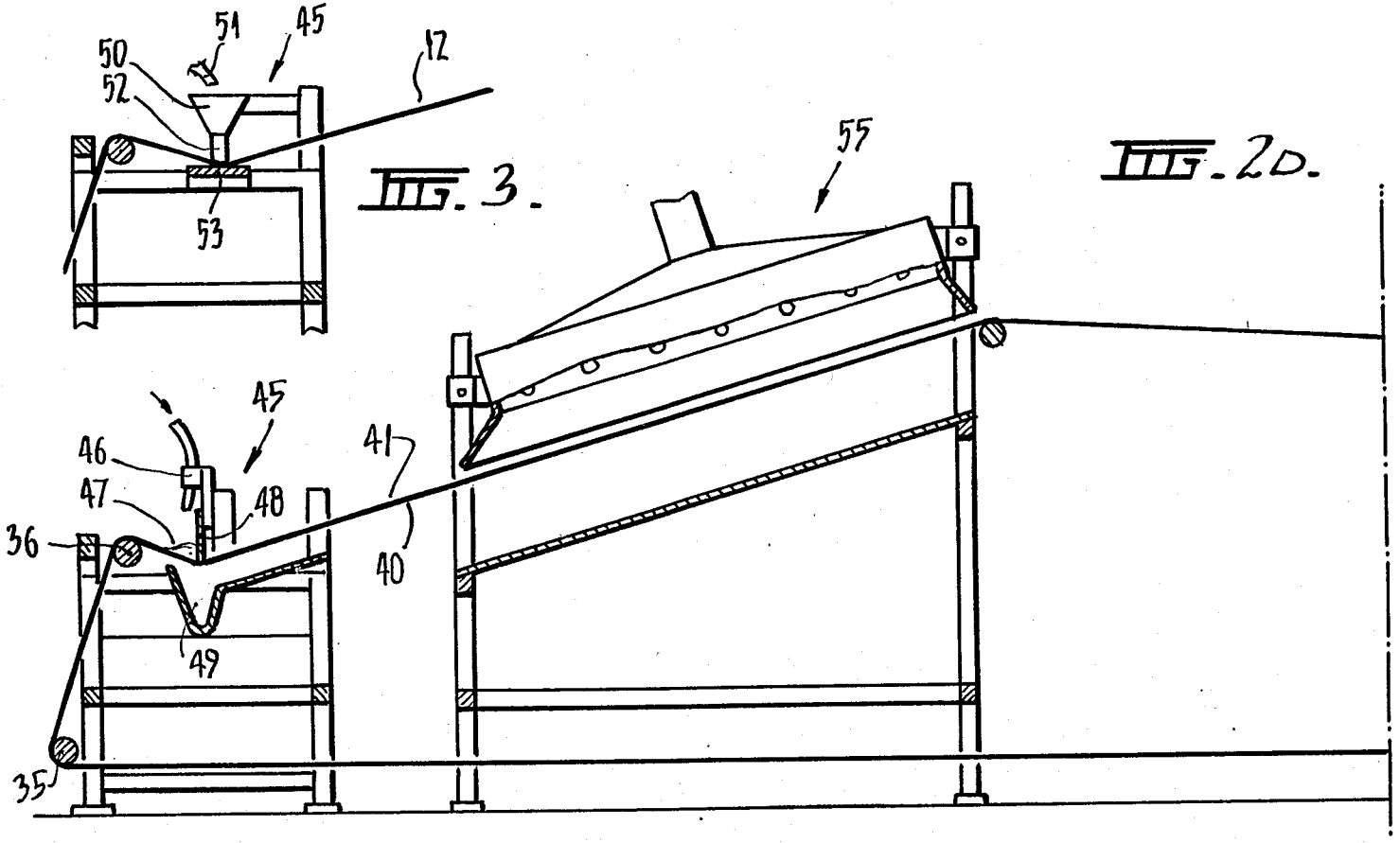

FIG. 3 is an alternative method of applying a coating in the station positioned therebelow in FIG. 2D.

In the illustrated embodiment I provide a delivery roller arrangement 10, illustrated in FIG. 2A, onto which a roll 11 of canvas web 12 may be readily placed and the free end of the web may pass around a series of tensioning rollers 13 which are relatively conventional.

The web 12 then passes to the first treatment station 14 where a fungicide is to be applied thereto. As illustrated the fungicide is applied to both sides of the web by the web passing under a roller 15 located in a bath 16 of fungicide. Alternatively the fungicide may selectively be applied to only the side of the web which will be the inner side of the completed web.

The web 12 then passes to a station 20 where a backing is applied to one surface thereof. As illustrated the backing material is applied by nozzles 21 with which there are associated blades 22 which spread the backing. Excess materials is passed to trough 23 from which it can be recycled or passed to waste.

From the fungicide bath 14 and backing station 20 the web passes under an infra-red heater 25 whereby the backing is substantially dried and is then constrained to move around a substantial part of the periphery of a heated roller 30 which is of such diameter and such a temperature as to be able to fully dry the web at the required rate of delivery of the machine without damaging the web by scorching or the like.

From the backing process the web passes to the end of the machine remote from the delivery roller 11 and by rollers 35,36 is caused to return towards the delivery roller. After passing roller 36 the surface 41 which was the underside on the first run becomes the upper side and this passes through a head 45 and a full or partial colour coating is applied thereto.

FIGS. 2D and 3. show two different ways of applying this coating.

In FIG. 2D I show a solid colour being applied by a coating source feeding a coating from a nozzle 46 to a dam 47 formed by a blade 48. A trough 49 can receive excess coating which can be passed for reuse on to waste.

In FIG. 3. the head 45 is a striping head and in this case the coating material is fed to a reservoir 50 from a nozzle 51 and selectively applies the coating through one or more nozzles 52 directly to the web as it passes between a nip formed between the nozzle(s) 52 and a backing plate 53.

From the colouring station 45 the web 12 passes beneath an infra-red heater 55 from whence it continues forwardly to a further treatment station 60 where an anti-soil and water repellent compound is supplied to the upper surface 41, that is the surface which is decoratively coated. The station 60 may include a blade 61 which forms a dam which is fed with the compound through a nozzle 62. A trough 63 receives the excess compound which may be recycled or passed to waste.

After station 60 the web passes over a heated roller 65 having the same characteristics, as far as the web is concerned, as the first heated roller 30. The dried web 12 passes to a take-up reel 70 which may have associated tensioning rollers.

It will be seen that by use of the apparatus of the present invention, all the necessary treatment of the web of fabric is effected during one pass through the machine and thus the virgin fabric can be placed on the delivery reel and fully completed fabric be removed from the take-up reel for later making up.

In this specification I have described heating by two heating rollers 30, 65 about which the web passes and infra-red heaters 25, 66 under which the web passes. It will be understood that any of these heating elements can be replaced by any other satisfactory heating elements, such as, for example, a tunnel drying oven, without departing from the scope of the invention.

Also, at the various work stations I have referred, generally, to means to apply liquid to a surface of the web as comprising a blade acting as a dam to spread liquid evenly over the surface of the web. Alternatively such means may comprise a series of rollers which pick up liquid from a reservoir, evenly distribute it over the periphery of the rollers and whereby the liquid is evenly transferred to the web or I may provide a spray delivery of liquid direct to the surface of the web.

In the decorative step, illustrated in FIGS. 2D and 3, I have referred to complete coats and to a striping head, as striping is relatively conventional on canvas, but it will be appreciated that the canvas may be decorated in any required way by providing a roller having a raised surface or even by using an intaglio printing process.

Any such operations, it will be appreciated, simply after the physical arrangement of one or other of the stations without altering the concept of the invention in any way.

In my description of the machine of the invention, I have not attempted, to fully describe the operation of tension rollers or drive means as these individually can be relatively conventional and could well be arranged by a person skilled in the art.

I claim:

1. A method for treating and coating a fabric web comprising supplying a web having an upper, first surface and a lower, second surface from a storage means located at or near a first end location in a first direction toward a second end location, passing the web through a first treatment station where a fungicide is applied to one surface thereof, passing the web through a second station located beyond said first station in said first direction where a backing coating is applied to the upper first surface thereof, passing the web through a heating, third station located beyond said second station in said first direction where the backing is dried, passing the web through a guide means located at said second end location whereby the second, downwardly directed surface becomes the upwardly directed surface with the web moving in a second direction of movement opposite to said first direction, passing the web in said second direction through a fourth station located intermediate said ends where a decorative coating is applied to the second, now upwardly directed surface, passing the web in said second direction through a heating, fifth, station where the decorative coating is dried, passing the web in said second direction through a sixth station where said second web surface is treated with a protective surface after the decorative coating has been at least partially dried, passing the web in said second direction through a heating, seventh station where heat is applied to said first web surface, and passing the web to a take up storage reel located intermediate said ends after drying is complete and winding the web with said second web surface being on the outside of a roll on said reel.

2. A method as claimed in claim 1 wherein the backing is applied to the web by spraying a liquid backing material thereon and spreading this with a blade extending across the width of the web.

3. A method as claimed in claim 1 wherein the decorative coating is applied to the web by spraying the material thereon and spreading this with a blade extending across the width of the web.

4. A method as claimed in claim 1 wherein the decorative coating is applied in longitudinal stripes along the length of the web.

5. A method of treating and coating a fabric web comprising supplying a web having an upper, first surface and a lower, second surface from a storage means located at or near a first end location in a first direction toward a second end location, passing the web through a first treatment station where a first material is applied to at least one surface thereof, passing the web through a second station located beyond said first station in said first direction where a first coating of a liquid material is applied to the upper first surface thereof, passing the web through a heating, third station located beyond said second station in said first direction where the first liquid coating material is dried, passing the web through a guide means located at said second end location whereby the second, downwardly directed surface becomes the upwardly directed surface with the web moving in a second direction of movement opposite to said first direction, passing the web in said second direction through a fourth station located intermediate said ends where a second coating of a liquid material is applied to the second, now upwardly directed surface, passing the web in said second direction through a heating, fifth station where the second liquid coating material is dried, passing the web in said second direction through a sixth station where said second web surface is treated with a protective surface after the second liquid coating has been at least partially dried, passing the web in said second direction through a heating, seventh station where heat is applied to said first web surface, and passing the web to take up storage reel located intermediate said ends after drying is complete, and winding the web with said second web surface being on the outside of a roll on said reel.

6. A method as claimed in claim 5 wherein the first coating material is applied to the web by spraying the liquid material thereon and spreading it with a blade extending across thw width of the web.

7. A method as claimed in claim 5 wherein the second coating material is applied to the web by spraying the material thereon and spreading it with a blade extending across the width of the web.

8. A method as claimed in claim 5 wherein the second coating material is applied in longitudinal stripes along the length of the web.

* * * * *